US005297798A

United States Patent [19]

Davila-Hernandez

[11] Patent Number: 5,297,798

[45] Date of Patent: Mar. 29, 1994

[54] BALL GAME APPARATUS FOR BATTING A BALL

[75] Inventor: Felipe Davila-Hernandez, Humacao, P.R.

[73] Assignee: Commonwealth of Puerto Rico, San Juan, P.R.

[21] Appl. No.: 83,325

[22] Filed: Jun. 29, 1993

Related U.S. Application Data

[63] Continuation of Ser. No. 11,786, Feb. 1, 1993, abandoned.

[51] Int. Cl.[5] ..... A63B 59/00

[52] U.S. Cl. ..... 273/342; 273/67 R; 273/323; 273/328; 273/412

[58] Field of Search ..... 273/67 R, 317, 318, 273/319, 320, 321, 326, 328, 340, 342, 412, 329

[56] References Cited

U.S. PATENT DOCUMENTS

| | | | |
|---|---|---|---|
| 1,189,921 | 7/1916 | Cory | 273/328 |
| 1,616,270 | 2/1927 | Madden | 273/342 X |
| 2,480,264 | 8/1946 | Regenold | 273/67 R |
| 3,714,246 | 12/1967 | Parisein | 273/67 R X |
| 4,047,717 | 9/1977 | DeAngelis | 273/412 X |
| 4,234,183 | 11/1980 | Stephens | 273/318 |
| 4,368,890 | 1/1983 | Horstman et al. | 273/328 |
| 4,375,890 | 3/1983 | Thomas | 273/320 |
| 5,082,289 | 1/1992 | Paranto et al. | 273/318 |

*Primary Examiner*—William H. Grieb

*Attorney, Agent, or Firm*—Oblon, Spivak, McClelland, Maier & Neustadt

[57] ABSTRACT

A bat in the form of a flat plate grasped at spaced positions by both hands of a player. A net is mounted centrally in the plate, a player endeavoring to bat a ball by maneuvering the plate with both hands without receiving the ball in the net.

4 Claims, 2 Drawing Sheets

BALL GAME APPARATUS FOR BATTING A BALL

This application is a continuation of application Ser. No. 08/011,786, filed on Feb. 1, 1993, now abandoned.

FIELD OF THE INVENTION

This invention relates to ball game apparatus and more particularly to ball game apparatus comprising an especially shaped bat carrying a net of a size to receive a ball designed to be struck by the bat.

BACKGROUND OF THE INVENTION

Bats carrying nets are well known but for the most part a ball is intended to be struck by the bat and subsequently caught in the net, such bats usually have a single handle and more often than not are intended to be used by a single player as, for example, in the patents to Cory U.S. Pat. No. 1,189,921 and to Regenold U.S. Pat. No. 2,480,264.

SUMMARY OF THE INVENTION

The object of the present invention is to provide ball game apparatus for batting a ball wherein the bat comprises an elongated flat plate having relatively widely spaced hand-holds adjacent opposite outer extremities of the plate, the purpose of the game being to propel a struck ball away from the plate by maneuvering both hands in such a way that the ball is caused to rebound in the direction of another player equipped with an identical bat. Each bat is equipped with a centrally located net and one object of the game is to prevent the ball from entering the net but should it do so a penalty is exacted usually calling for the player dropping out of that round of play.

DETAILED DESCRIPTION OF THE INVENTION

Figure 1:
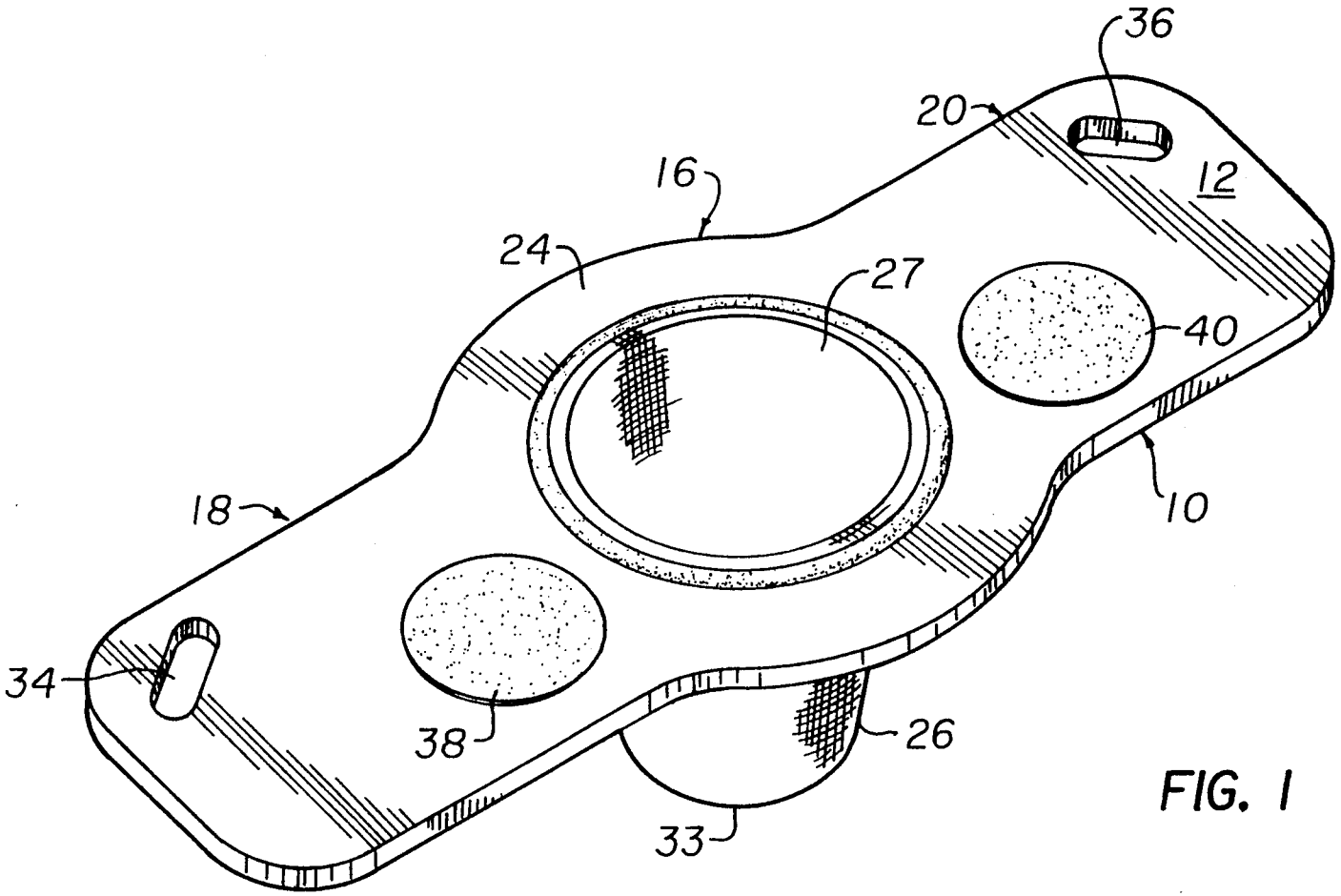
FIG. 1 is a perspective view of a bat constructed in accordance with the invention.

With reference now to the drawings the ball game apparatus of the invention comprises a unitary substantially rigid planar plate 10 defining a bat having flat upper and lower surfaces 12, 14. The plate 10 has a central part 16 flanked by oppositely extending wing parts 18, 20 having less lateral breadth than that of the central part 16.

An opening 22 (FIG. 3) passes symmetrically through the central part 16 of the plate and is of a size as to leave between its periphery and the periphery of the central part an annular region 24 surrounding the opening 22. The wing parts 18, 20 are joined to the central part 16 on diametrically opposite sides of the opening 22.

Figure 3:
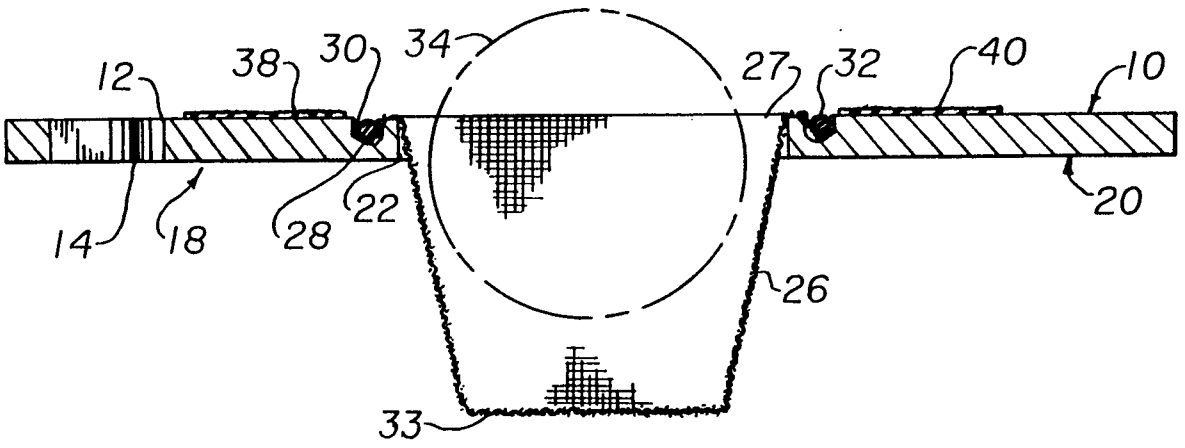
FIG. 3 is a vertical cross-sectional view taken substantially on the line 3—3 of FIG. 2.

A net 26 has an open end 27 surrounded by a rim 28 connected to the flat upper surface of the central part 16 of the plate and surrounding the opening 22. As best seen in FIG. 3, the net rim 28 may conveniently be connected to the plate by means of an annular groove 30 into which the rim 28 may be pushed and there trapped by flexible liner material 32 in the same way that screening is connected to the frame of a metal screen door. As can be seen, the net 26 extends from the flat upper surface 12 of the plate 10, through the opening 22 and terminates in a closed bottom 33 substantially beyond the flat lower surface 14 of the plate.

Oppositely sloping hand holes 34, 36 are provided adjacent corresponding respective outer extremities, remote from the opening 22, of the respective wing portion 18, 20.

As should be apparent the flat outer surface 12 of the plate 10 beyond the opening 22 and net 26 defines a hitting area for batting a ball away from the plate when: (a) the latter is grasped by the hands of a player in both hand-holds 34, 36; and (b) a ball is in a position to impinge on the flat upper surface 12 of the plate. The opening 22 for the net 26 and the net itself are of a size to receive therein a ball 34 intended to be batted by the plate.

Desirably, the perimeter of the central part 16 is substantially circular and the outer perimeter of each of the wing parts 18, 20 is substantially rectangular except where the wing and central parts merge. The hand-holes 34, 36 slope in opposite directions diagonally across the same corresponding corners of the respective wing parts 18, 20. Desirably the corners of the wing parts are rounded as shown.

Figure 2:
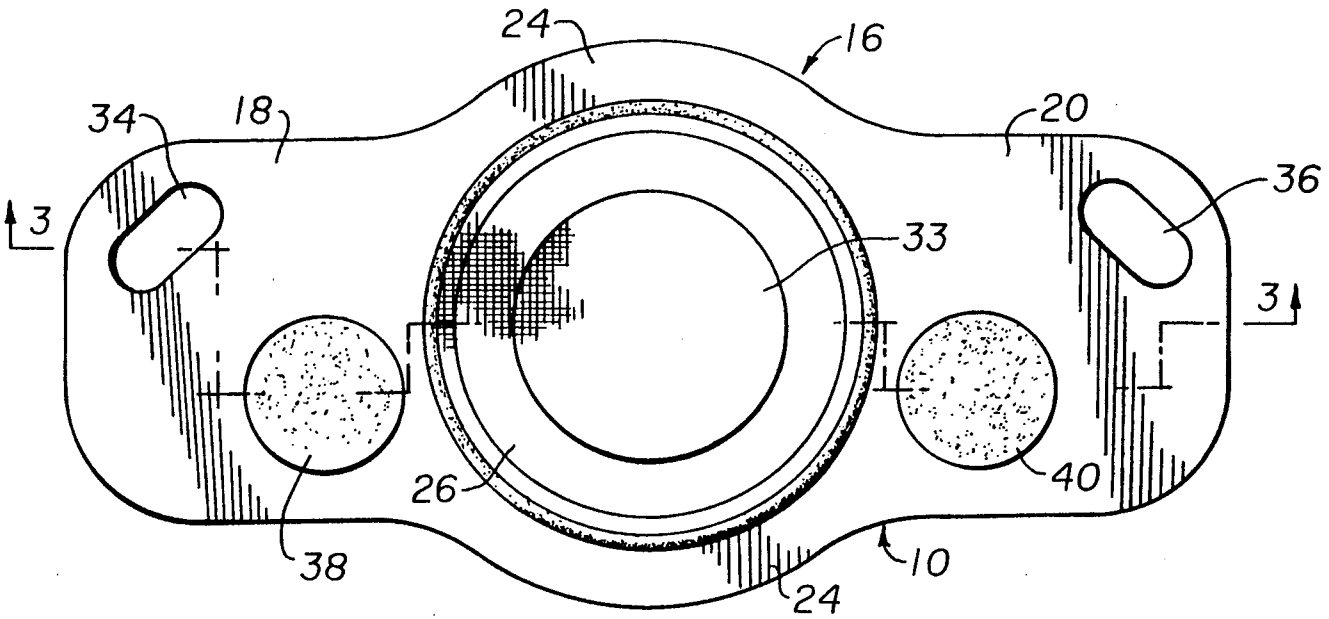
FIG. 2 is a horizontal plan view of the bat of FIG. 1.

In accordance with the invention, a pair of resilient pads 38, 40 of substantially less area than the flat upper surface 12 of the plate 10 are mounted symmetrically with respect to the opening 22 on the flat upper surface 12 of the plate as best seen in FIG. 2. The pads 38, 40 have a surface which imparts a rebound to a ball when struck thereby which is distinctly different from the rebound imparted to the ball when struck by any portion of the flat upper surface 12 of the plate which is clear of the pads 38, 40.

In use, one of two or more players, each equipped with a plate of the invention and grasped by both hands in the hand-holds 34, 36, propels a ball from his board towards another player who, in turn, attempts to strike the ball by manipulating the plate to propel the ball towards another player. The receiving player may strike the ball with the flat surface 12 of the plate whereupon the rebound of the ball has one quality. Should the ball impinge on one of the pads its rebound will have a different quality which adds to the interest of the game. In any event, a player tries to prevent the ball from entering the net but should this occur, that player drops out of the competition and the game continues with the other contestants until only one remains who has avoided receiving the ball in the net and he is the winner for that round of play. Clearly the game is well-suited for use at the beach though it can be played wherever open space permits.

Having now described the invention, I claim:

1. Ball game apparatus for batting a ball comprising a unitary, planar, substantially rigid plate defining a bat having flat upper and lower surfaces, said plate having a central part flanked by oppositely extending wing parts having less breadth than said central part, an opening passing symmetrically through said central part of said plate and of a size as to leave between its periphery and the periphery of said central part an annular region of said central part surrounding said opening, said wing parts being joined to said central part on diametrically opposite sides of said opening, a net having an open outer end and a rim surrounding said open end connected to the flat upper surface of the central part of said plate, said net extending from said flat upper surface of said central part, through said opening to terminate in a closed end beyond said flat lower surface of said plate, and oppositely sloping hand-holes adjacent respective corresponding outer extremities of said wing parts remote from said opening, said flat upper surface of said plate beyond said opening and net defining a batting area for batting a ball away from said plate when the latter is grasped by the hands of a player in both said hand-holes.

2. The ball game apparatus of claim 1 wherein the outer perimeter of said central part is substantially circular and the outer perimeter of each of said wing parts is substantially rectangular except where said wing and central parts merge, said hand-holes sloping in opposite direction diagonally across the same corresponding corners of said wing parts.

3. The ball game apparatus of claim 2 including a pair of resilient pads of substantially less area than said flat upper surface of said plate mounted symmetrically with respect to said opening on said flat upper surface of said plate, said pads having a surface imparting a rebound to a ball when struck thereby which is distinctly different from the rebound imparted to a ball when struck by any portion of said flat upper surface of said plate which is clear of said pads.

4. Ball game apparatus for batting a ball comprising a planar, substantially rigid plate defining a bat having flat upper and lower surfaces, said plate having a central part flanked by oppositely extending wing parts having less breadth than said central part, an opening having a diameter greater than said ball and passing symmetrically through said central part of said plate, said opening being of a size as to leave between its periphery and the periphery of said central part an annular region of said central part surrounding said opening, said wing parts being joined to said central part on diametrically opposite sides of said opening, and handles adjacent respective corresponding outer extremities of said wing parts remote from said opening, said flat upper surface of said plate beyond said opening defining a batting area for batting a ball away from said plate when both said handles are grasped by the hands of a player.

* * * * *